US008715034B1

(12) United States Patent
Wong

(10) Patent No.: US 8,715,034 B1
(45) Date of Patent: May 6, 2014

(54) SMART DRIVING SYSTEM IN TOY VEHICLE

(71) Applicant: Silverlit Limited, Causeway Bay (HK)

(72) Inventor: Kwok Leung Wong, Causeway Bay (HK)

(73) Assignee: Silverlit Limited, Causeway Bay (HK)

( * ) Notice: Subject to any disclaimer, the term of this patent is extended or adjusted under 35 U.S.C. 154(b) by 0 days.

(21) Appl. No.: 14/064,023

(22) Filed: Oct. 25, 2013

(51) Int. Cl.

| | |
|---|---|
| ***A63H 30/00*** | (2006.01) |
| ***A63H 18/16*** | (2006.01) |
| ***A63H 30/04*** | (2006.01) |
| ***A63H 17/40*** | (2006.01) |

(52) U.S. Cl.
CPC ..... *A63H 18/16* (2013.01); *A63H 30/00* (2013.01); *A63H 30/04* (2013.01); *A63H 17/40* (2013.01)
USPC ..... 446/454; 446/456; 446/441

(58) Field of Classification Search
CPC ..... A63H 30/00; A63H 30/04; A63H 17/42; G08C 17/02
USPC ..... 446/175, 484–456
See application file for complete search history.

(56) References Cited

U.S. PATENT DOCUMENTS

| | | | | |
|---|---|---|---|---|
| 7,097,532 | B1 * | 8/2006 | Rolicki et al. | 446/175 |
| 8,287,327 | B1 * | 10/2012 | Ghaly | 446/297 |
| 2007/0293124 | A1 * | 12/2007 | Smith et al. | 446/454 |
| 2009/0081923 | A1 * | 3/2009 | Dooley et al. | 446/456 |
| 2010/0099493 | A1 * | 4/2010 | Horovitz | 463/31 |
| 2010/0304640 | A1 * | 12/2010 | Sofman et al. | 446/456 |

* cited by examiner

*Primary Examiner* — William Brewster
*Assistant Examiner* — Alex F. R. P. Rada, II
(74) *Attorney, Agent, or Firm* — Greenberg Traurig, LLP

(57) ABSTRACT

A toy car and a remote control regulate the speed and movement of the car. A source of power energizes the drive motor thereby to change the vehicle speed and stopping. One or more sensors measure the speed and environment barriers relative to the vehicle. The drive motor speed can be increased decreased or stopped. The toy vehicle with a battery operates as a rechargeable system. A station on a track has an outlet on or in adjacency with a surface on which the remotely controllable toy is movable to and from electrical outlet contacts. The remote controlled toy has inlet contacts for electrically engaging the outlet contacts. The station is part of a track and the toy vehicle is normally directed to travel on the track and to a station.

23 Claims, 18 Drawing Sheets

Transmitter

Traffic light

SMART DRIVING SYSTEM IN TOY VEHICLE

FIELD OF DISCLOSURE

The present disclosure relates generally to toy vehicles and, more particularly, to remote control toy vehicles.

BACKGROUND

A variety of toy vehicles such as a toy car are known. Like a real car, remote control toy cars are usually designed to achieve travel and speed with good controllability. A toy vehicle design having a system to regulate speed and operating conditions would be desirable and provide enhanced entertainment value.

In the real world, the driver slows down and stops a car when the driver notices that a front car's brake lights are illuminated or a red traffic light is on. Similarly, a driver steps on the accelerator pedal for moving forward if the driver notices that the brake lights are turning off or a green traffic light is on.

SUMMARY

The present disclosure is for a toy vehicle, and includes with the vehicle a low cost sensor system. An infrared receiver plus an IRed are put with a toy vehicle such as a car. These sensors are associated with smart driving software, to act as the function of a visual system effectively for the driver or player of the toy. The sensors monitor the status of traffic lights or brake lights of a front car. As a result, the car behind should not collide with a car ahead.

The toy vehicle can be regulated in its speed and movement. A source of power energizes the drive motor thereby to change the vehicle speed and stopping. One or more sensors measure the speed and environment barriers relative to the vehicle. The drive motor speed can be increased decreased or stopped. The toy vehicle with a battery operates as a rechargeable system. A station on a track has an outlet on or in adjacency with a surface on which the remotely controllable toy is movable to and from electrical outlet contacts. The remote controlled toy has inlet contacts for electrically engaging the outlet contacts. The station is part of a track and the toy vehicle is normally directed to travel on the track and to a station.

The present disclosure provides a toy for amusement to the user.

The disclosure is further described with reference to the accompanying drawings.

DRAWINGS

The above-mentioned features and objects of the present disclosure will become more apparent with reference to the following description taken in conjunction with the accompanying drawings wherein like reference numerals denote like elements and in which.

Figure 1:
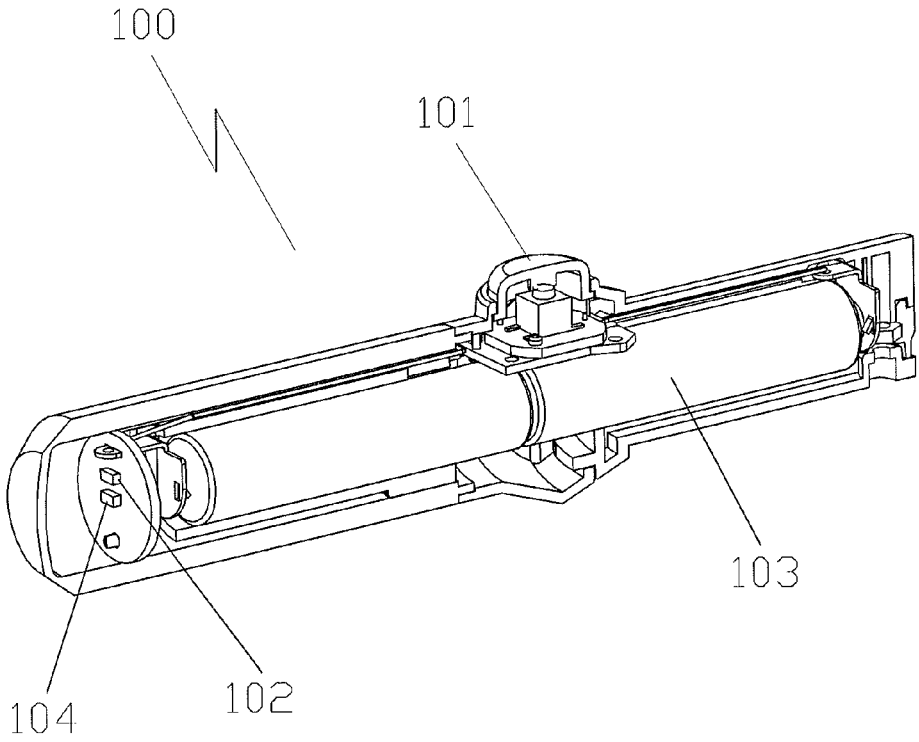
FIG. 1 is an exploded view of the transmitter.
Figure 2:
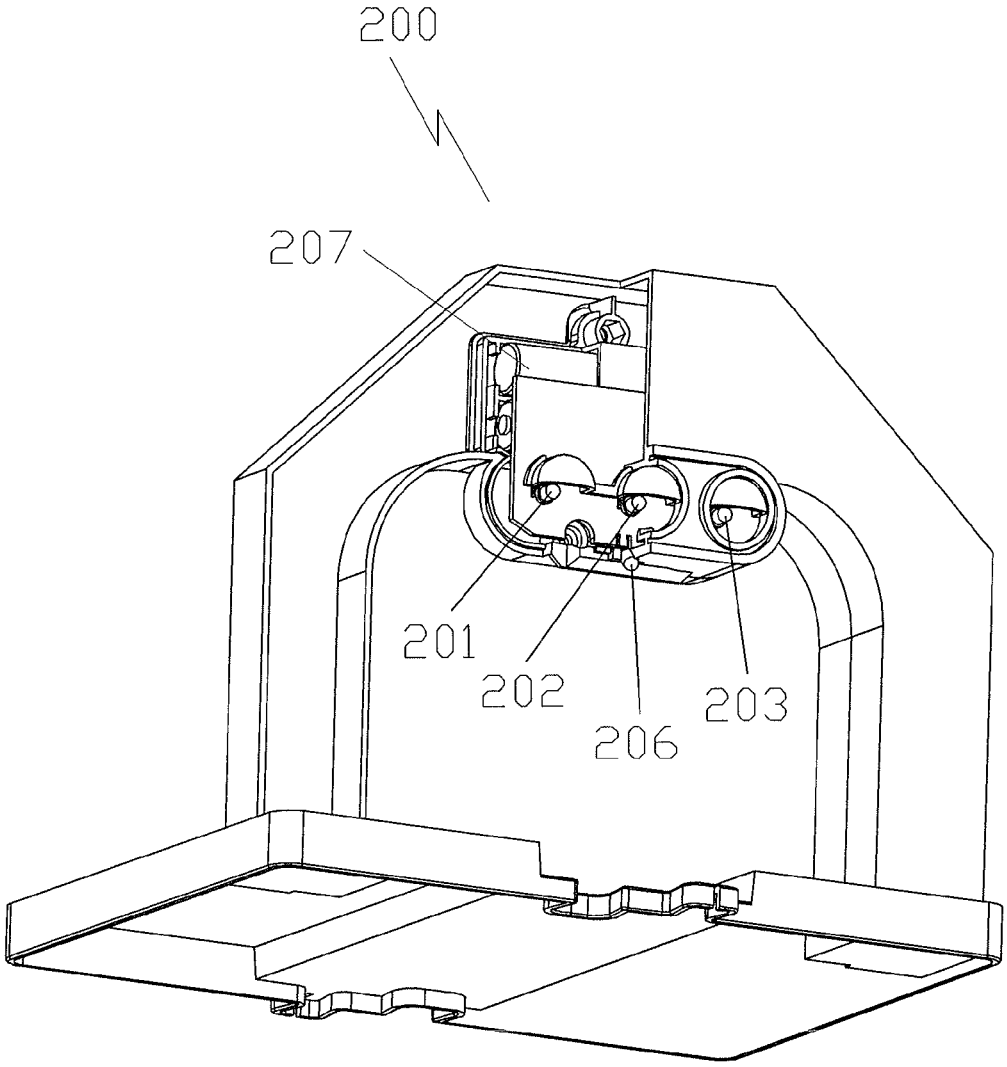
FIG. 2 is a perspective view of the traffic light.
Figure 3A:
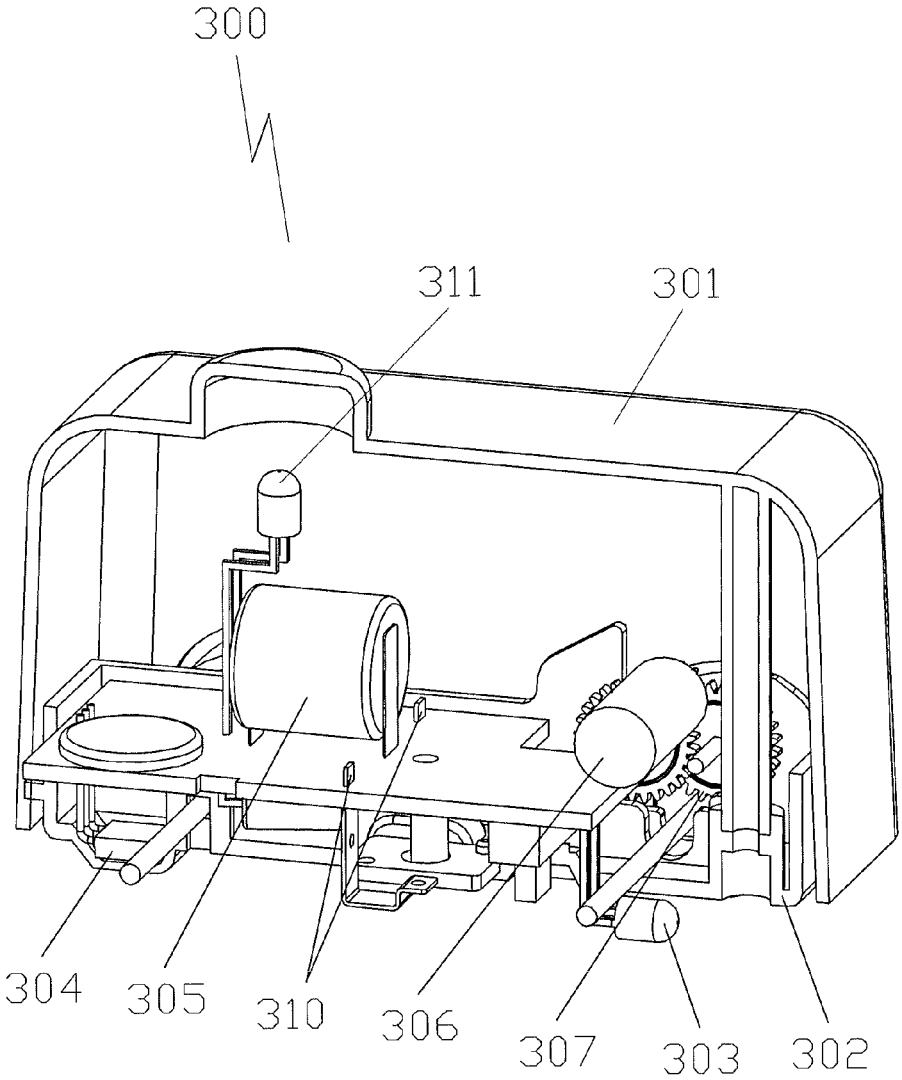

FIG. 3*a* is an exploded view of the car.

Figure 3B:
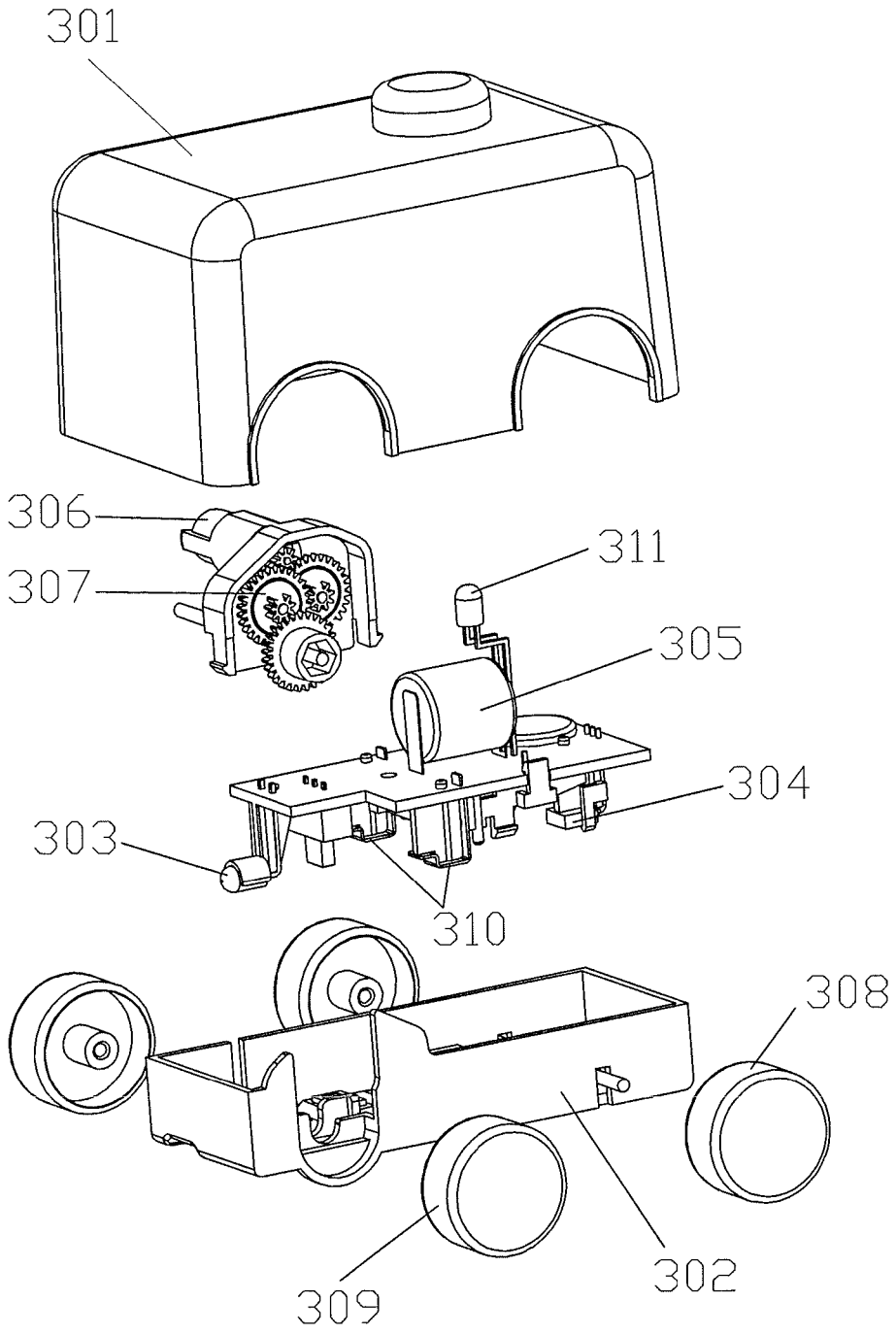

FIG. 3*b* is another exploded view of the car.

Figure 4:
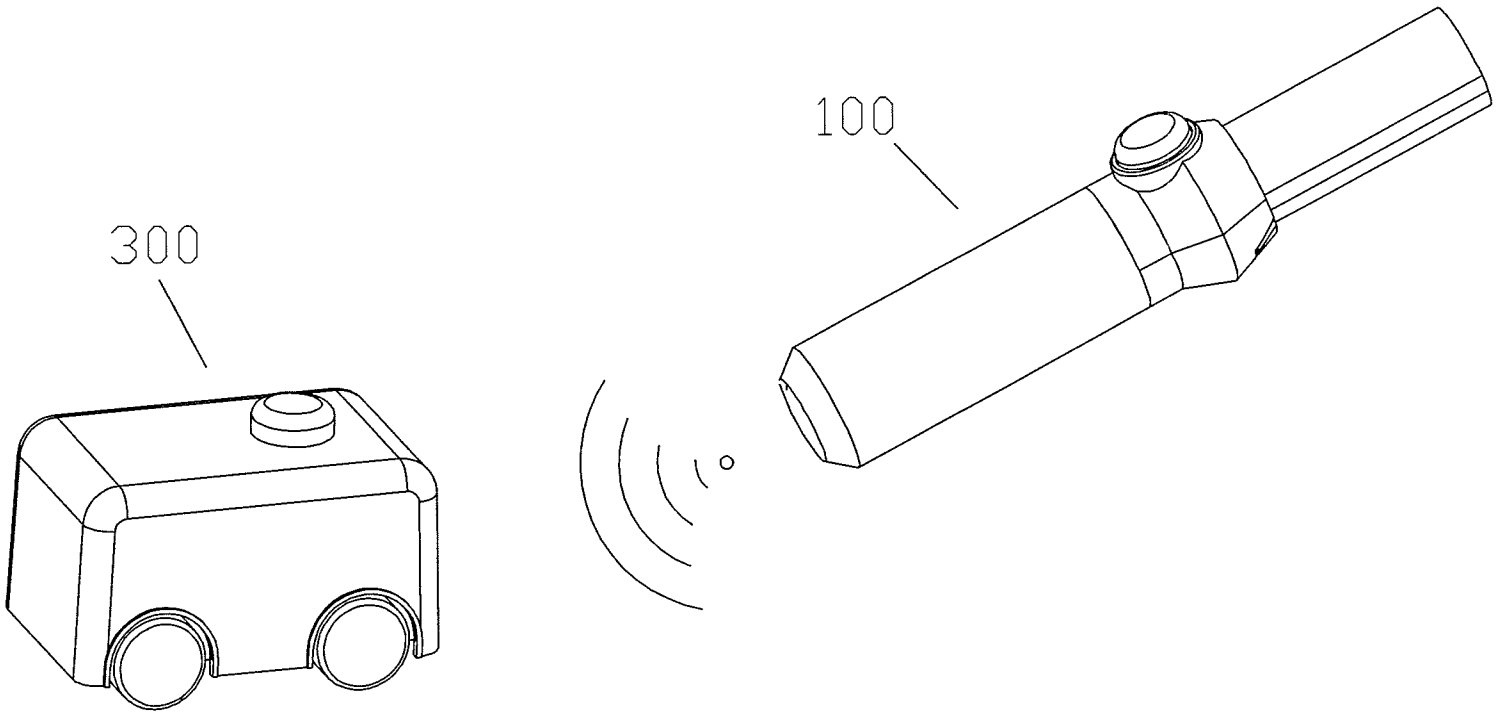

FIG. 4 shows the transmitter sending a signal to the car.

Figure 5A:
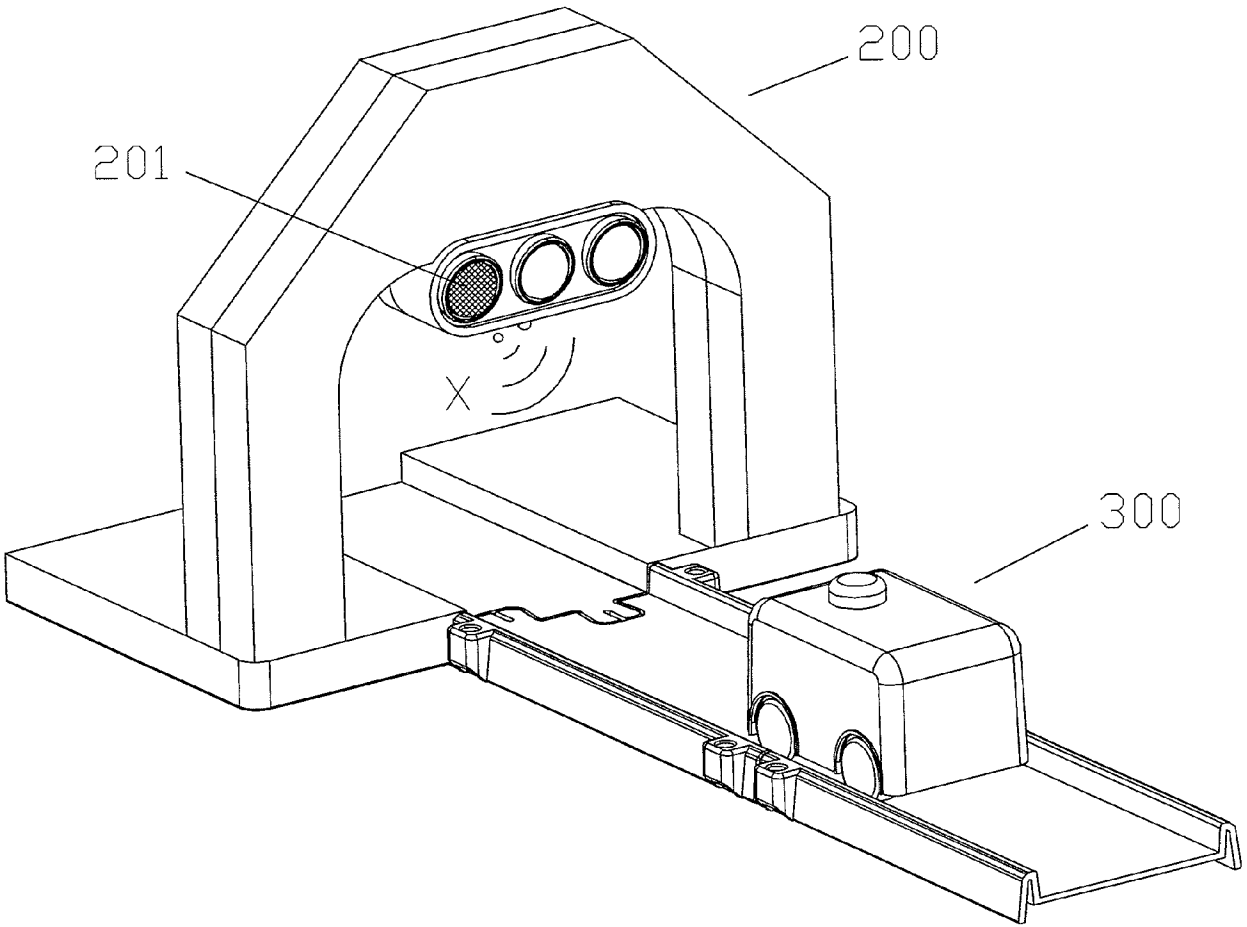

FIG. 5*a* shows a traffic light sending an X (Red) signal to the car when a Red light on.

Figure 5B:
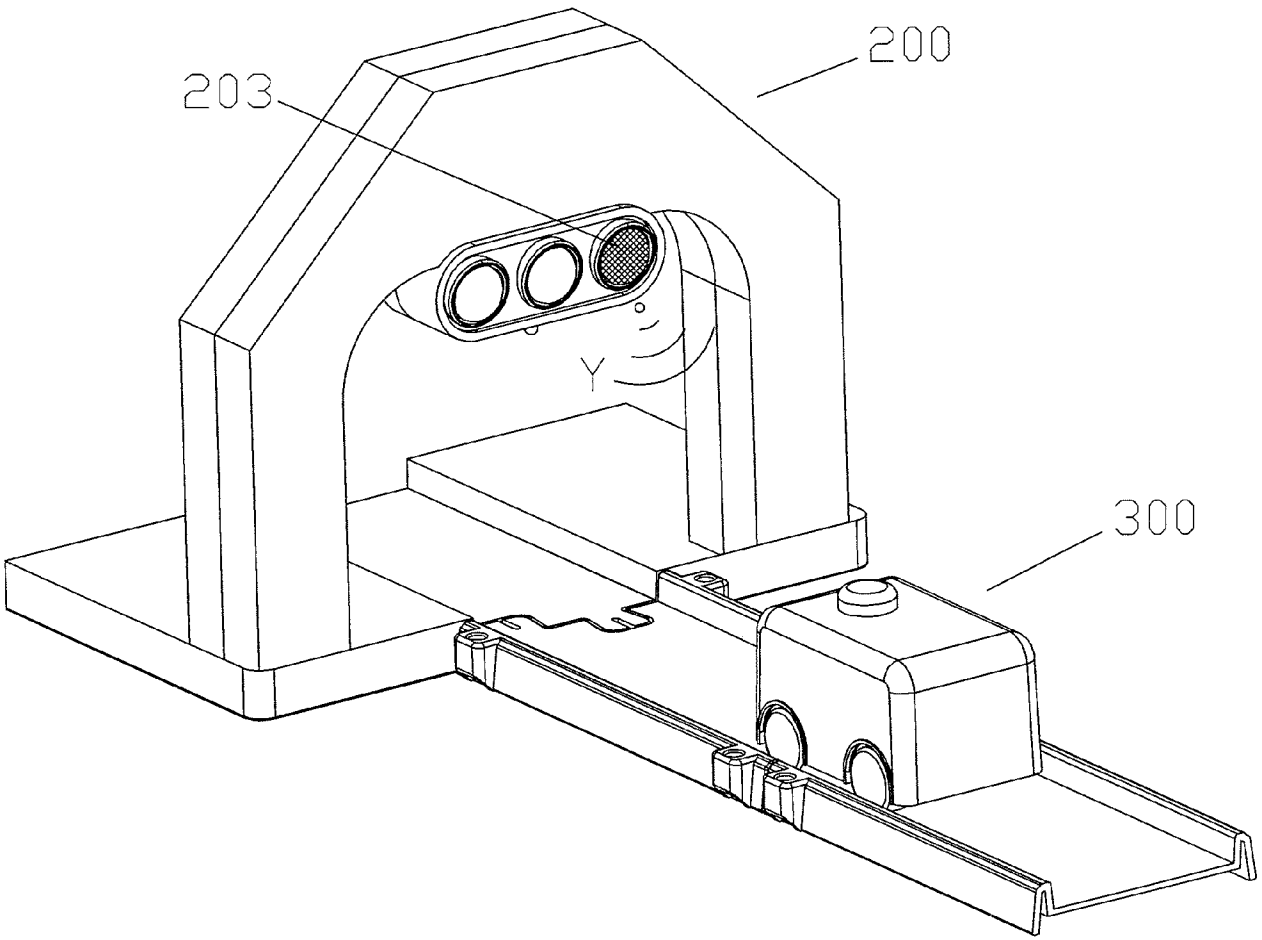

FIG. 5*b* shows a traffic light sending Y (Green) signal to the car when a Green light on.

Figure 6A:
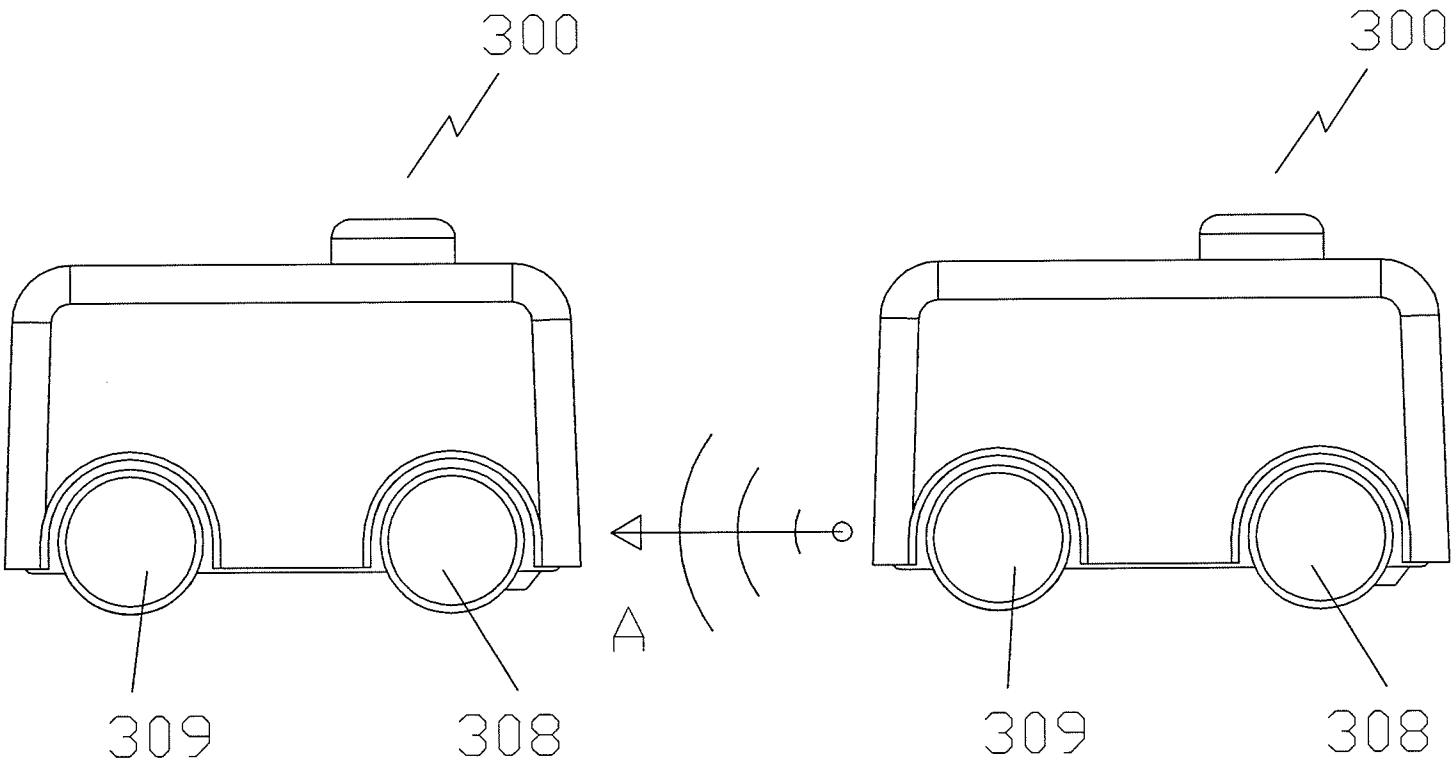

FIG. 6*a* shows that while the front car is moving and the distance between the rear and front car is short, the rear car can receive an A (Slow) signal.

Figure 6B:
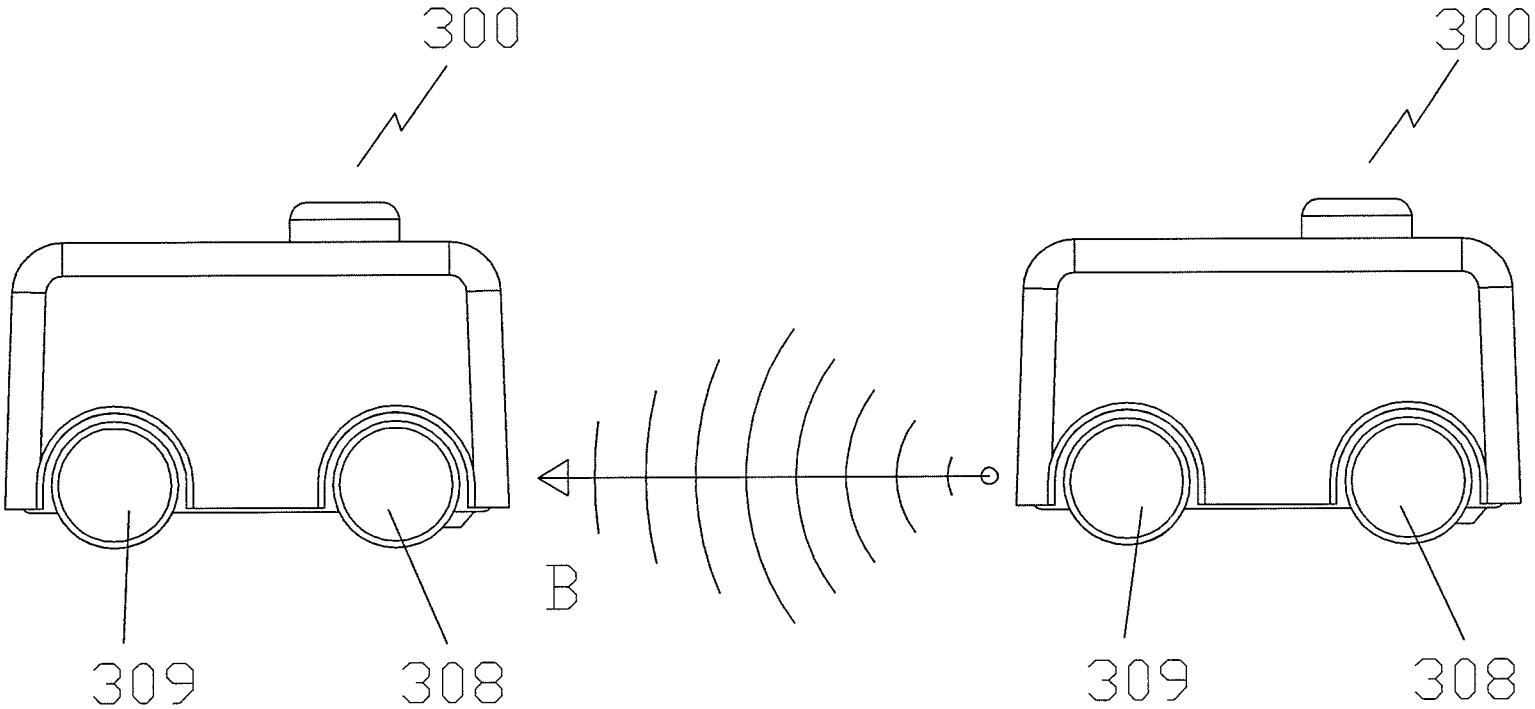

FIG. 6*b* shows that while the front car is stopping and the distance between the rear and front car is medium, the rear car can receive a B (Brake) signal.

Figure 6C:
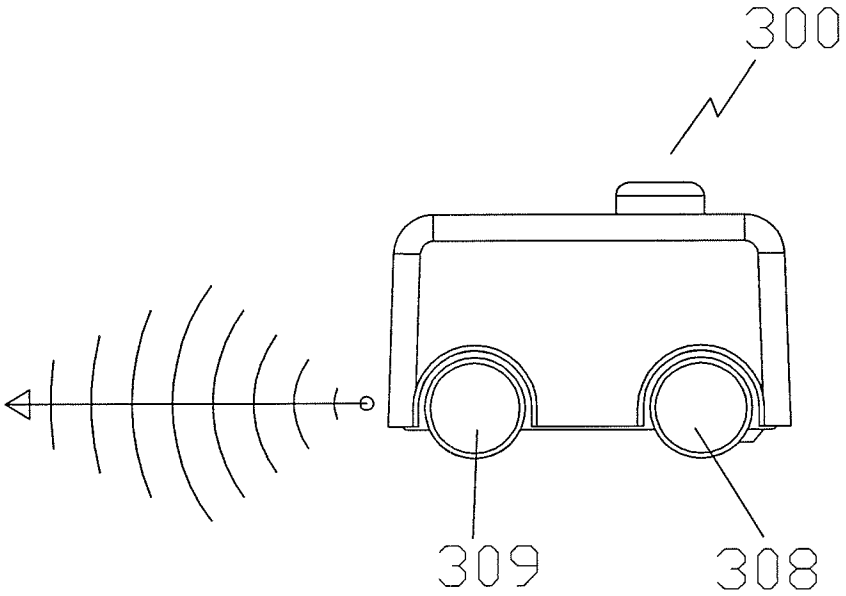
Figure 6C:
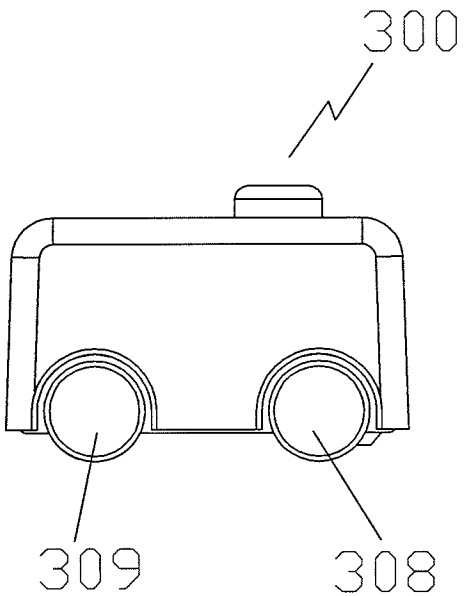

FIG. 6*c* shows when the distance between the rear car and the front car is long, the rear car can't receive any signal from the front car.

Figure 7A:
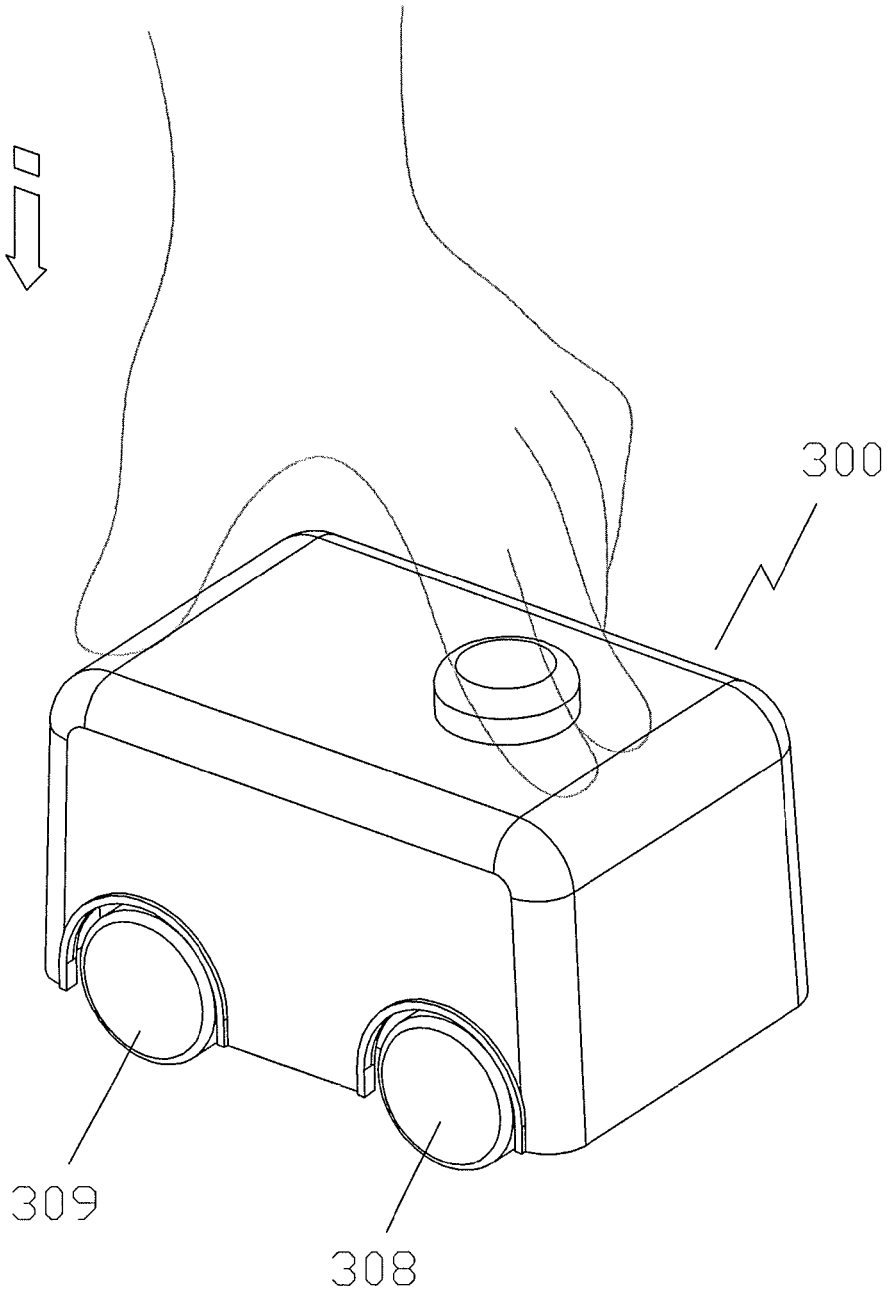

FIG. 7*a* shows use of a hand to stop the car so as to cut the driving motor power.

Figure 7B:
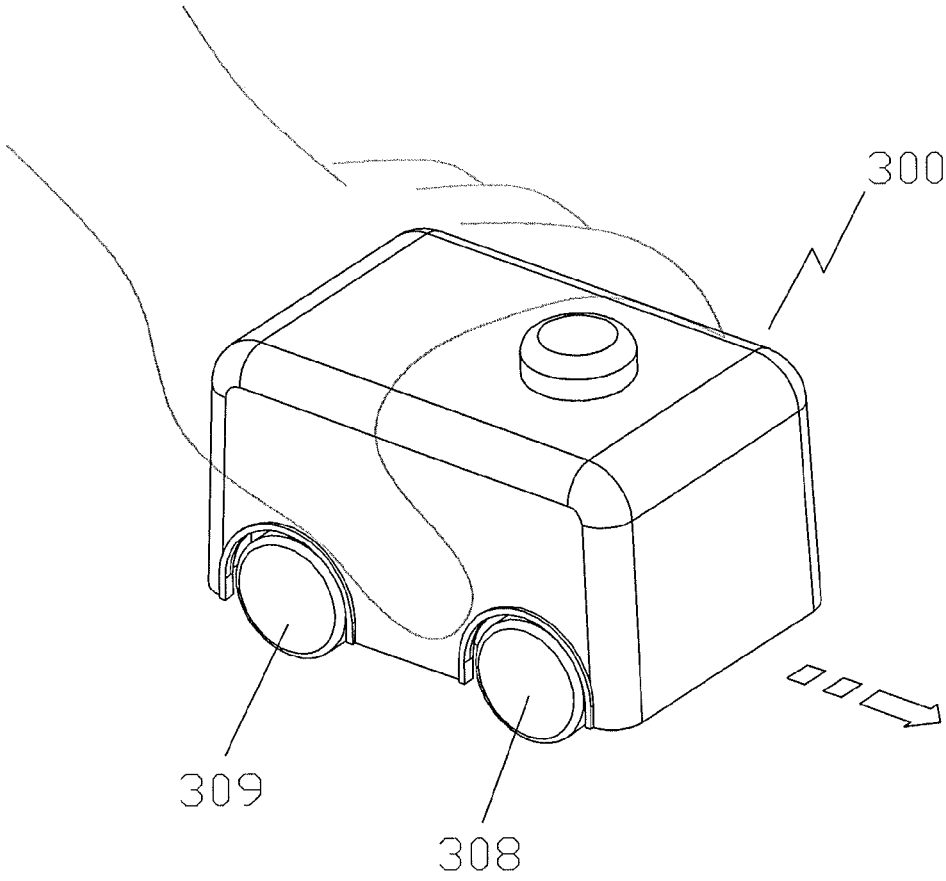

FIG. 7*b* shows use of a hand to pull the car so as to activate the driving motor.

Figure 8:
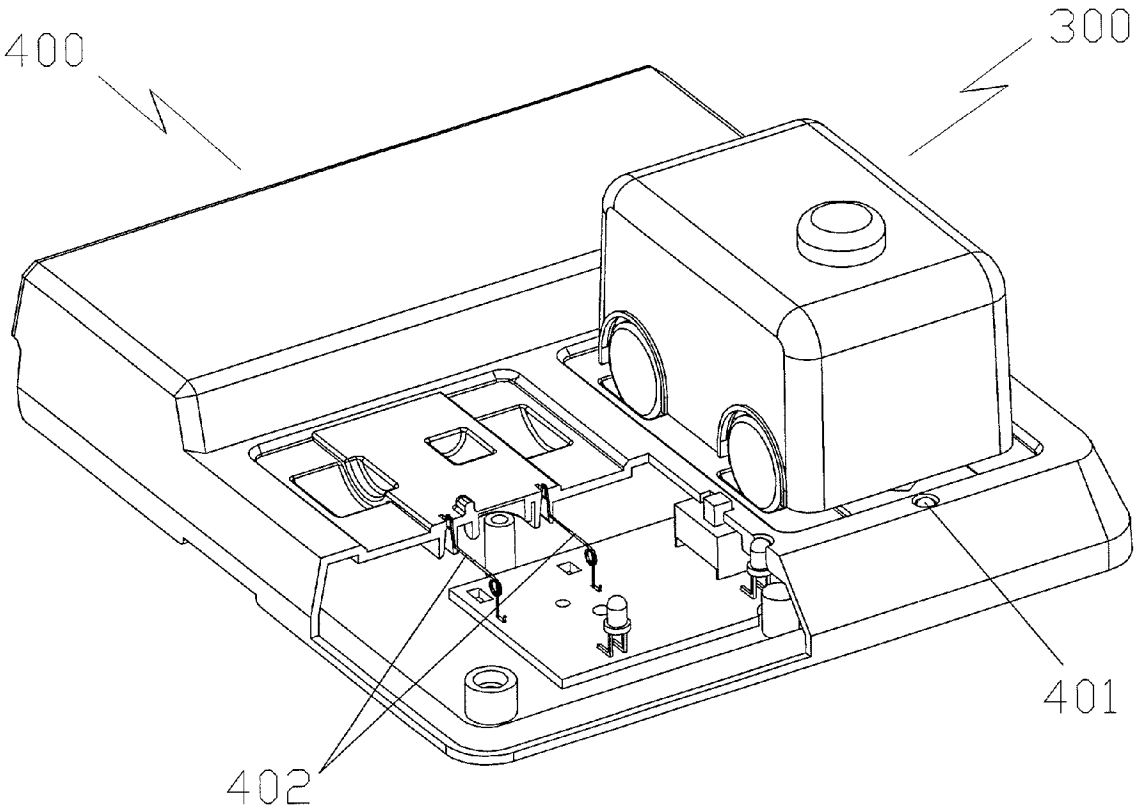

FIG. 8 shows one car is charging on a charging station.

Figure 9:
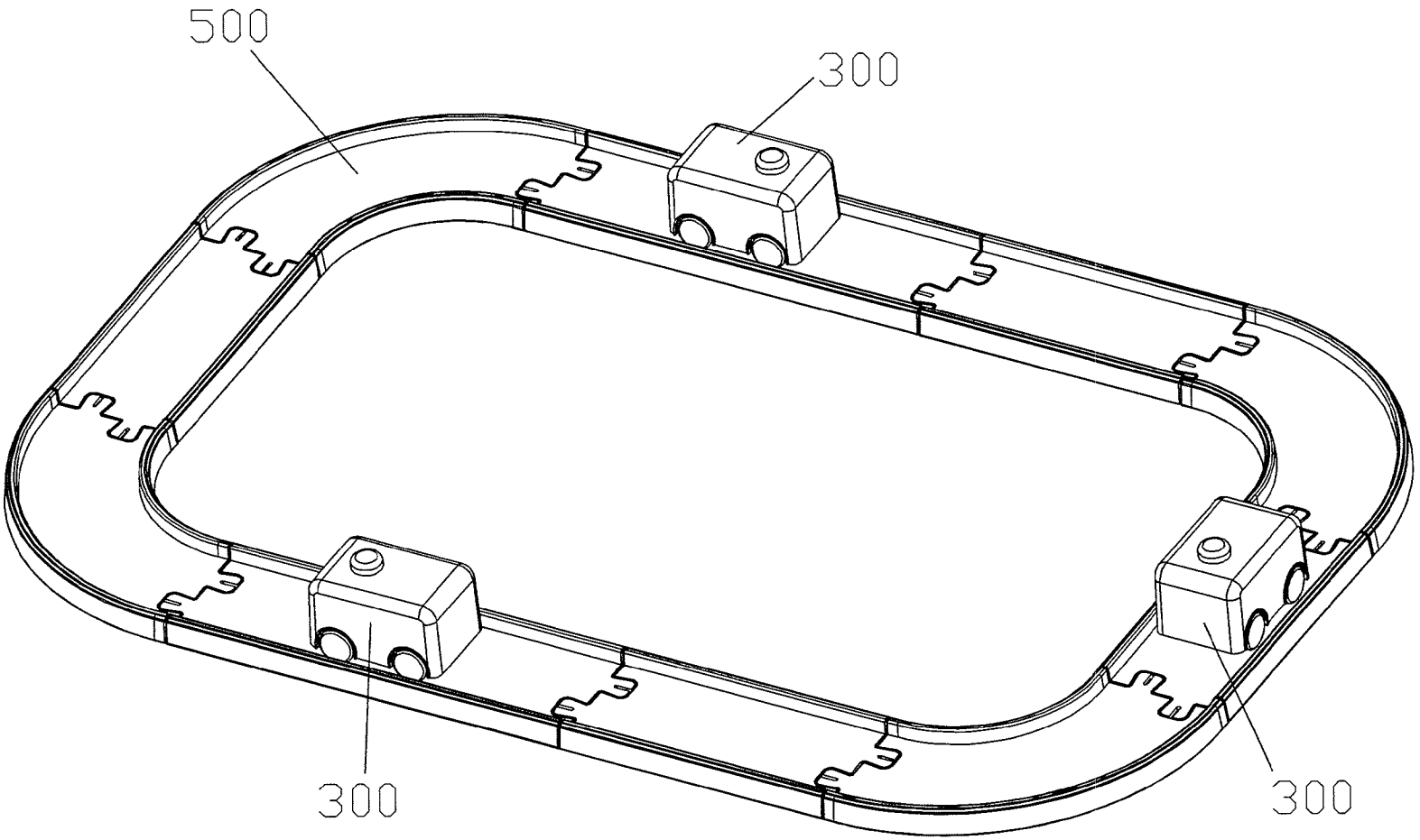

FIG. 9 shows three cars on a circular track set.

Figure 10:
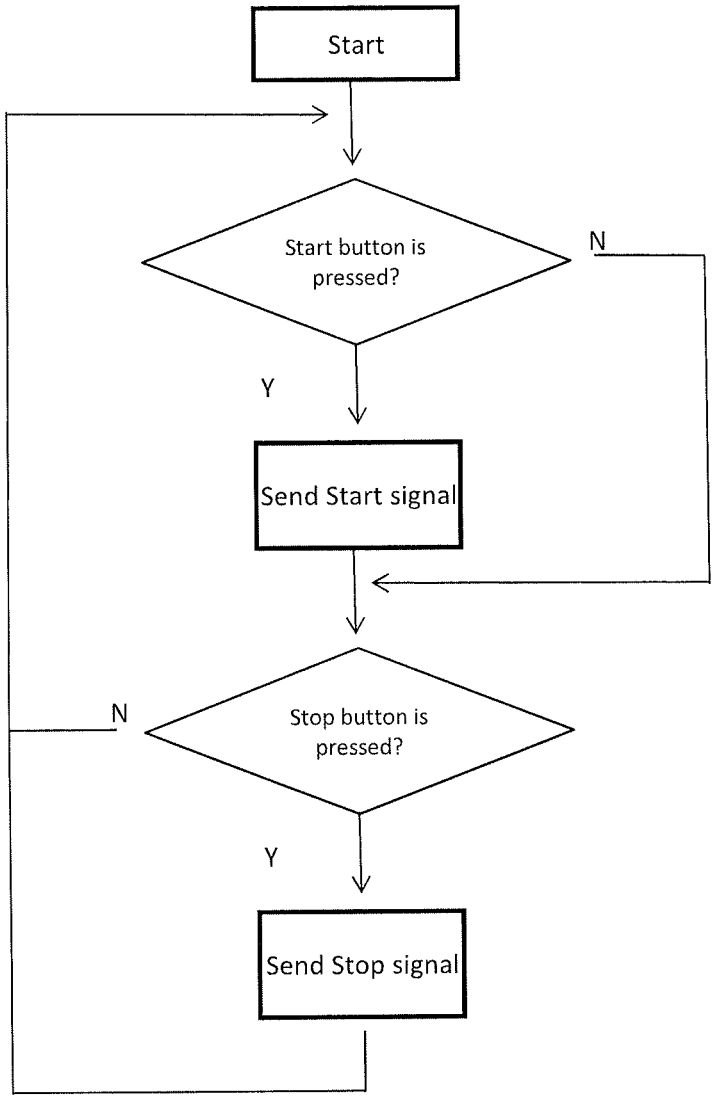

FIG. 10 is a flow chart of a transmitter operable with smart driving software algorithm.

Figure 11:
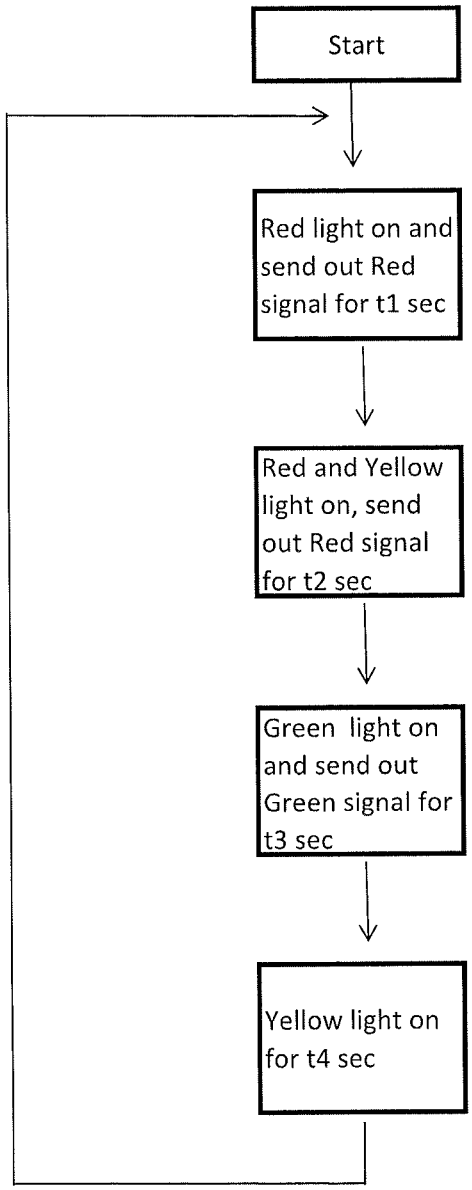

FIG. 11 is a flow chart of a traffic light operable with smart driving software algorithm.

Figure 12A:
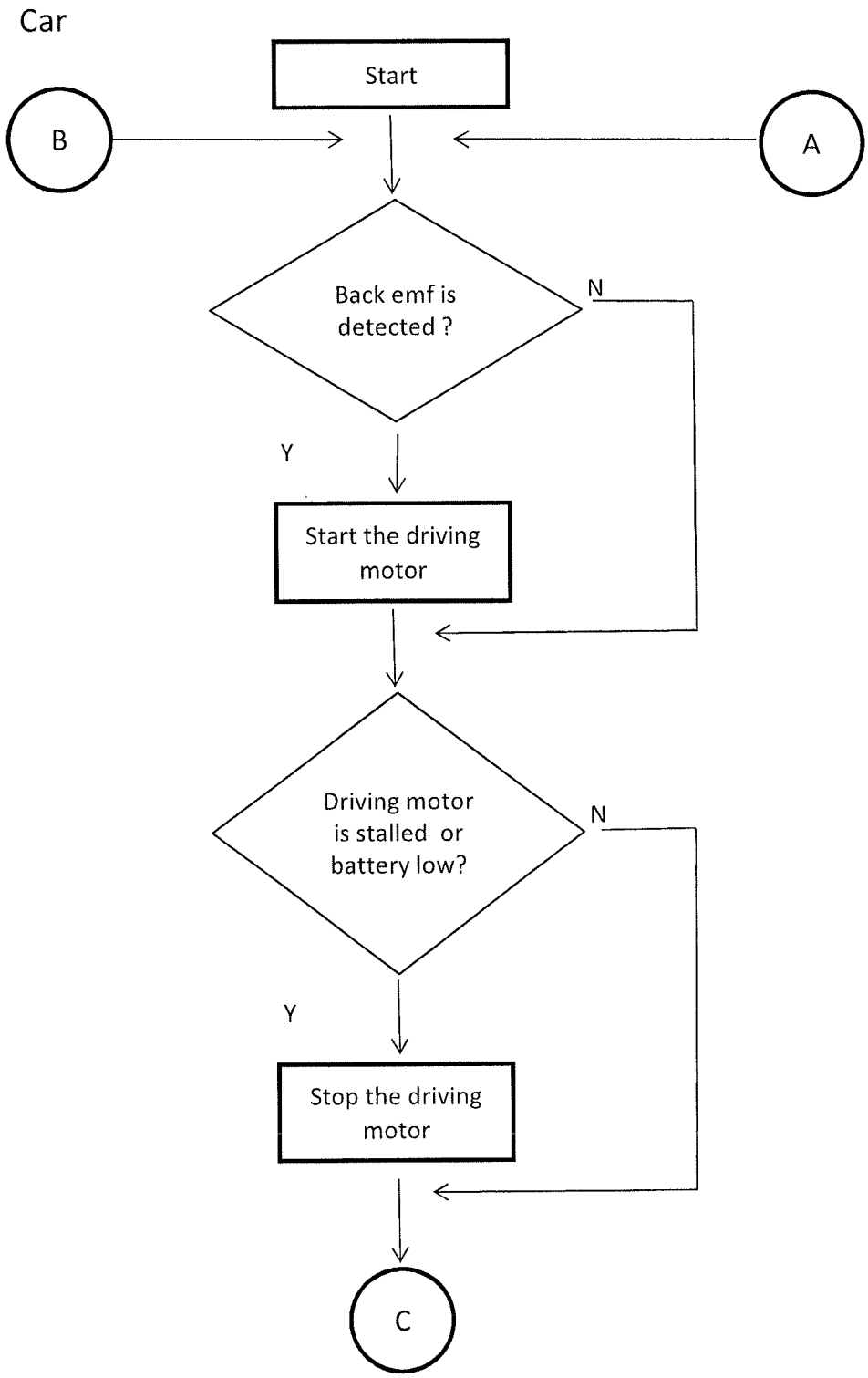
Figure 12B:
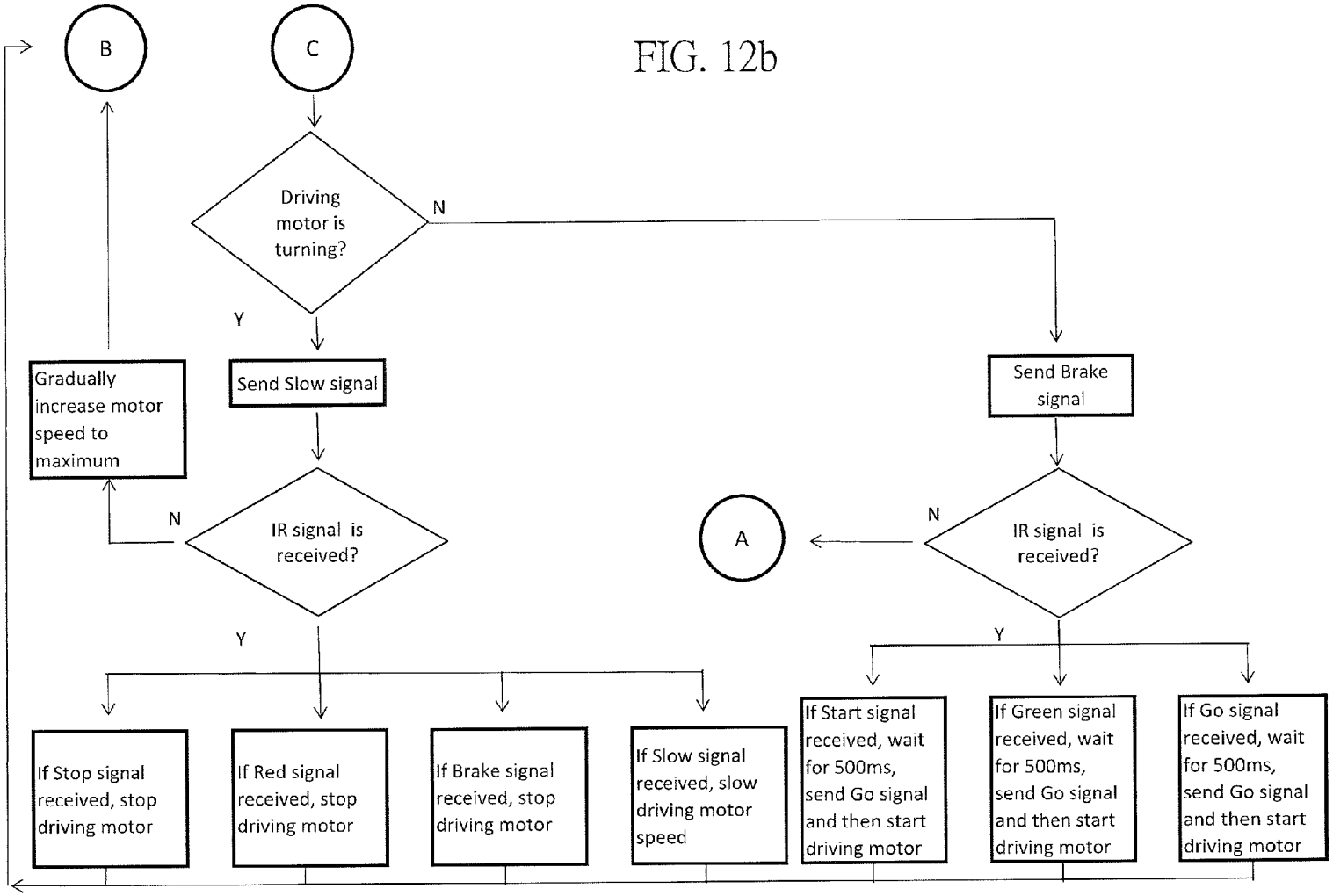

FIGS. 12*a* and 12*b* represent a flow chart of a toy car operable with smart driving software algorithm.

DETAILED DESCRIPTION

The numbering system in relation to the drawings is as follows.

| No | Description |
|---|---|
| 100 | Transmitter |
| 101 | Start/Stop button |
| 102 | Ired on transmitter |
| 103 | Battery |
| 104 | LED |
| 200 | Traffic light |
| 201 | Red LED |
| 202 | Yellow LED |
| 203 | Green LED |
| 206 | Ired on traffic light |
| 207 | Battery |
| 300 | Car |
| 301 | Top body |
| 302 | Chassis |
| 303 | Ired on car |
| 304 | IR receiver |
| 305 | Rechargeable battery |
| 306 | Motor |
| 307 | Gear box |
| 308 | Front wheel |
| 309 | Rear wheel |
| 310 | Contact terminal |
| 311 | LED |
| 400 | Charging station |
| 401 | LED |
| 402 | Contact plates |
| 500 | Track set |
| X | Red IR signal command |
| Y | Green IR signal command |
| A | Slow IR signal command |
| B | Brake IR signal command |

A toy vehicle and method includes a movable vehicle comprising a body, wheels, a battery, the battery with the toy being for powering a motor with the toy to move the toy, and a drive control for responding to sensors with the toy. There are sensors for sensing and monitoring the environment about the toy such as the presence, movement or removal of objects about the toy. This sensing, monitoring and reporting or responding to changes in the environment causes one or more signals to be sent to a programmed circuit for generating a signal to the powering of the motor so that respectively the vehicle can move, stop or turn the toy in a travel trajectory.

A toy and method of operating a movable toy comprises a movable toy having electrical contacts for electrically engaging charging station contacts when directed to a charging station. A battery with the toy is for powering a motor with the toy to move the toy; and there is a rechargeable system for charging the battery. A drive control responds to the sensors within the toy.

The method includes steering of the toy and includes receiving at least one of an RF programmable voice, or IF controllable signal from a remote controller operable by a user of the toy. The method includes directing the toy selectively in a recharge station or track and the toy vehicle is normally directed to travel on the track.

According to one aspect of the disclosure, the toy vehicle is provided with a vehicle body, chassis, power source with at least one battery, electronic circuit board for motor speed control, and receiving remote signal from transmitter. There is at least one electric motor for driving a wheel of the vehicle, an electric motor for wheel steering control and a gear box associated with a wheel and electric motor for power transmission.

There is a remote controller to send a signal which is received from the remote control transmitter. An electric motor can act with at least one of the front wheels for steering control. A gear box is associated with at least one rear wheel and the electric motor for power transmission.

A toy comprises a movable toy vehicle such as a toy car and a remote control device having controls for a user to regulate the movement being the speed or stopping of the vehicle. The vehicle can be driven at different speeds.

The car preferably includes a pair of front wheels spaced apart to either side of the vehicle body, and preferably a pair of rear wheels spaced apart to either side of the vehicle body. There is a remote control device for communicating with a transceiver located within the vehicle. The remote control device includes one or more control levers also for regulating the rotation of the driven wheel. As such the vehicle can be controlled by the microcontroller to automatically control the speed of rotation and steering to the wheels, and the stopping and starting of the vehicle. The microcontroller is also programmed with smart driving software.

The toy is a combination with a remote control device configured to selectively control movement and speed of the toy vehicle and activation of the rotational drive mechanism.

In some other cases the toy does not have a remote controller, and the car operates independently under the smart driving software in a microcontroller built on the MCU with the car.

In one case a toy vehicle receives a programmed, programming or programmable signal to effect operation of the driving mechanism such that the toy is drivable by the remote controller.

A transmitter in the remote controller sends a programming, programmed or programmable signal to the receiver; and the toy being drivable under remote control by signals from the transmitter to the receiver. At least one sensor with the vehicle determines at least one of sensing a vehicle-in-front slowing down, sensing a vehicle-in-front stopping, sensing of a vehicle-in-front brake lights illumination, monitoring the occurrence of a traffic light; and monitoring of a change in a sensed traffic light. The sensor can determine at least one of vehicle acceleration or a vehicle-in-front acceleration.

There can be sufficient different sensors with the vehicle to determine at least any selected combination or one, two, three, four or all of sensing a vehicle-in-front slowing down, sensing a vehicle-in-front stopping, sensing of a vehicle-in-front brake lights illumination, monitoring the occurrence of a traffic light; and monitoring of a change in a sensed traffic light.

At least one sensor is part of a sensor system, and there is an infrared receiver and smart driving software for acting as an effective functional visual system for responding to the sensing of a brake light of a vehicle-in-front thereby to minimize vehicle collision likelihood with the vehicle-in-front or the monitoring of a traffic light.

The toy vehicle can include a toy system having a lane track path, and a plurality of vehicles for location in the track.

Smart driving software is programmed or programmable to effect at least one action on the vehicle, according to the following protocol. When the monitor senses a red traffic light, the smart driving software acts to stop the vehicle substantially immediately. When the monitor senses a green traffic light, the vehicle moves. When a sensor senses a vehicle-in-front stopping, the smart driving software acts to stop the vehicle substantially and immediately to avoid a collision. When a vehicle in front begins to move, the smart driving software acts to keep a vehicle behind waiting for a short while, and then permits start of movement.

The vehicles in the track can have different speeds, and the software is signaled about the differences in speed of different vehicles thereby to minimize a chance of a collision. When a battery in a vehicle is low, the software is signaled, and the vehicle behind is notified to thereby effect a collision avoidance reaction. When a vehicle is stopped and is removed from the track by a player, the software is signaled, and the vehicle behind responds by moving itself automatically.

The transmitter includes a communication protocol of at least one of infrared, radio control, Bluetooth or WiFi control.

A method of operating a toy vehicle comprises pressing a start/stop button to toggle the start or stop operation of a vehicle with a corresponding ID. Alternatively, the transmitter employs a separate start and stop button, and while pressing the start button, the transmitter sends out a start IR signal with unique ID. A vehicle with a corresponding ID starts to move forward. Pressing the Stop button, causes the transmitter to send out a stop IR signal with a unique ID; and a vehicle with a corresponding ID stops substantially immediately.

The smart driving system is useful especially in a single lane track set with plurality no of cars in the circuit. The smart driving system and software algorithm operates such that:

1. When the car sees the red traffic light, it stops immediately.
2. When the car sees the green traffic light, it moves.
3. When a front car stops, it stops immediately.
4. To avoid a collision when a front car begins to move, the car behind will keep waiting for a short while, within hundreds of ms, and then it will start to move.
5. When cars have different speeds, a faster car will eventually hit a slow car if they are driving in a single lane closed loop track set, so the system ensures effective spacing in the track.
6. When a battery in a car is low, the car will go slow and stop finally. The car behind is notified of this case and takes a corresponding reaction to avoid a collision.
7. When a stopped car is removed from the track set by player, the car behind is notified and enabled to respond to this situation by moving itself automatically.

A detailed description of the smart driving system is set out.

The transmitter comprises:

a. at least one Start/Stop button;

b. at least one IRed; and c. at least one MCU to generate IR signals.

Pressing the Start/Stop single button toggles the start or stop operation of a car with corresponding ID.

Alternatively, the transmitter can have separate Start and Stop buttons for each respective car. While pressing the Start button, a Start IR signal with unique ID is transmitted. A car with a corresponding ID will start to move forward. While pressing a Stop button, a Stop IR signal with unique ID is sent out. A car with a corresponding ID will stop substantially immediately.

The effective range of IR signal can be up to several meters in order to cover all regions within the track set.

In some cases, the transmitter can have Forward, Backward, Left and Right button. In this way, it supports full function control and it is allowed to play the car off the track set.

Alternatively, the transmitter can have a universal ID in which the Start and Stop IR signal are suitable for all cars with different ID.

Alternatively, the whole smart driving system can work properly without transmitter.

The control method of transmitter is Infrared, radio control or Bluetooth or WiFi control.

A detailed description of the traffic light is set out.

The traffic light comprises:

a. at least one set of Red, Yellow/Amber, Green LED;

b. at least one IRed for sending Red or Green command; and c. at least one MCU to generate IR signals and control the light patterns and sequence of traffic light LED.

When red light is on, it sends out Red IR signal command. If a car enters the signal effective zone and receives this signal, the car will stop immediately.

When green light is on, it sends out Green IR signal command. If a car is already stopped within the signal effective zone, the car will wait for short while and then start to move automatically.

The signal effective zone is usually located in front of traffic light and the coverage area is up to around 2 to 5 times of car dimension so that it will not influence other cars beyond this area.

A detailed description of the car is set out.

The car comprises:

a. at least one IR receiver;

b. at least on IRed; and c. at least one rechargeable battery.

There can be one or a plurality of motors and several wheels for moving Forward, Backward, Left and Right. There are contact terminal on the chassis for recharging.

One MCU is to drive motors, to control LEDs, to handle the signals from IR receiver, to send IR signals to rear direction, to detect the back e.m.f. signal from motor and to monitor the motor stalled signal. In different cases there can be several MCUs.

Upon receipt of a Stop IR signal from the transmitter or a Red IR signal from traffic light or Brake IR signal from a front car, the car will stop moving forward.

While stopping, upon receipt of a Start IR signal from the transmitter or a Green IR signal from traffic light or Go signal from front car, the car will wait for a while. Then send out the Go IR signal several times to the rear direction before the car moves forward.

While stopping, the car sends out a Brake IR signal periodically. Once a rear car receives this signal, this car will stop too.

While moving forward, the car sends out a Slow IR signal periodically. Once a rear car receives this signal, this car can change its forward speed gradually.

If the car is slowed down by a Slow IR signal or stopped by a Red or Brake IR signal, and then when these signals change or disappear, the car starts to move again automatically.

If a low battery is detected, the car will stop the driving motor. The car will then send out a Brake IR signal to the rear direction until the battery is totally flat.

The effective range of a Go IR signal and a Brake IR signals is up to eight times of car length so that it will not affect the cars in other regions of the track set.

The effective range of Slow IR signal is less than that of the Go signal or the Brake signal. Thus the car behind can receive this signal only if it gets close to the front car.

The car can be equipped with an over-current detection design. When a player holds at least one of the driving wheels and experiences a stalled motor, the microprocessor can measure this unexpected high current and stop the motor power automatically.

The car can be equipped with a back e.m.f. detection design. When the motor stops, no back e.m.f. signal can be generated from the motor. On the other hand, once the player applies an external force to make the driving wheels turned, the motor will induce back e.m.f. The microprocessor can measure this voltage change and activate the driving motor at which point the car starts moving.

Alternatively, we can put one more IRed on the front side so that the Smart Driving System can also be applied when the car moves backward. In addition, it is allowed to have two-way communication with the front or rear car, and to exchange their status through wireless IR signaling.

Alternatively, the car can be driven by a plurality of button cells, alkaline or heavy duty batteries.

The track set is comprised of a set of plastic track which can be used to construct at least one complete loop in 2D or 3D pattern.

The charging station can recharge up to two cars at the same time.

The remote control device comprises a handheld remote controller having a multi-part housing, and wherein at least two of the housing parts are pivotable or movable with respect to each other in order to control an operation of the toy vehicle.

The steering assembly is coupled to the wheel assemblies to provide powered steering control. The steering assembly is preferably a conventional design that includes a motor, a slip clutch and a steering gear box, all of which can be contained within motor and gear box housing. A steering actuating lever can extend from the motor and gear box housing, and moves from left to right. The steering actuating lever can fit within a receptacle in a tie rod. The tie rod is provided with holes at each opposing end. The steering pivot pins fit within the holes. As the tie rod moves left and right under the action of the steering actuating lever, the front wheel assemblies are caused to turn as support arms are pivoted by steering pivot pins. The position of the tie rod can be adjustable by a steering trim mechanism. One of ordinary skill will appreciate that any known steering assembly can be used with the present disclosure to provide steering control of the toy vehicle.

The body of the vehicle can be ornamented with cover assemblies. The housing and chassis mounts a drive motor for one or more rear wheel assemblies mounted to an axle, and mounted for rotation relative to the housing and chassis. The housing and chassis can include drive shaft support members.

A circuit board containing the device's electronics is supported by a mounting with the chassis and housing. The circuit board is electrically connected with the front motor and rear motor. An on/off switch is accessible from the underside of the housing and chassis.

The drive assembly can include one or two drive motors. The drive motors can be reversible electric motors of the type generally used in toy vehicles. The motors are operably coupled to the axle through a drive gear train. The drive gear train includes a pinion affixed to an output shaft of the drive motors. The motors can drive the rear wheel assemblies through the drive gear train in either a forward or reverse direction. Other drive train arrangements could be used such as belts or other forms of power transmission. The arrangements disclosed herein are not meant to be limiting.

A special track includes two separate contact strips which run down the middle of the track 500 which are for engagement with contacts, and which are associated with the vehicle housing and chassis, and are connected to the circuit board. In this manner power from the strips can be imparted to charge the batteries in some forms of the disclosure. In other forms, the power from the strips is directly transferred to power the motor when the strips are powered and the car passes over the strips so that the contacts close the over circuit.

In operation, a user drives the toy vehicle so that the vehicle can continue driving in the selected forward or reverse direction. The microcontroller on board is signaled by the voltage sensor and it acts to change the speed of rotation of the wheels of the vehicle as desired, and control or impart different speeds under appropriate conditions.

The vehicle can be constructed of, for example, plastic or any other suitable material such as metal or composite materials. From this disclosure, it would be obvious to one skilled in the art to vary the dimensions of the toy vehicle 300 shown, for example making components of the toy vehicle smaller or larger relative to the other components.

The toy vehicle is preferably controlled via wireless signals such as Infrared or radio signal from a remote controller. However, other types of controllers may be used including wired controllers, voice-activated controllers, and the like.

A preferred embodiment of a remote controller for use with the present disclosure preferably comprises a multi-part housing having left hand and right hand toggles. Each of the left hand and right hand toggles are on a top housing. An antenna may be included to receive and/or transmit signals to and/or from the remote controller.

The remote controller also preferably includes circuitry to, for example, process inputs from the switch, the left and right toggles, switches, and to transmit and receive signals to and from the toy vehicle.

There can be a station for a recharger unit which has an outlet on or in adjacency with a surface on which a toy is movable, and electrical outlet contacts. The toy has inlet contacts for electrically engaging the outlet contacts when steered to the station. When the toy is steered under remote control to the station and the outlet contacts and inlet contacts electrically engage, a rechargeable current is passible from the electrical outlet contacts Steering the toy by a remote control device to engage the electrical outlet contacts is effected through the wheels. The toy also has means for receiving at least one of an RF, programmable, voice, or IF controllable signal from a remote controller operable by a user of the toy. The remote controller can have a suitable transmitter for transmitting the signals.

The arrangement is such that when the toy is steered by remote control to the station and the outlet contacts and inlet contacts electrically engage, a rechargeable current is passible from the electrical outlet contacts to the electrical inlet contacts, thereby enabling recharging of the rechargeable battery.

The toy is preferably a 4-wheeled vehicle.

Preferably there are spaced inlet contacts longitudinally directed along at least a part of the length of a toy vehicle. The inlet contacts are located below a base for the toy vehicle. The outlet contacts are located on or along the longitudinal rail, the outlet contacts being directed longitudinally. The rail is for receiving a vehicle steered to the station with the rail being located longitudinally and substantially centrally between transverse wheels of the vehicle.

In a preferred form of the disclosure there is a stop for stopping the toy movement when the toy is in a recharge mode and including means for deactivating the stop and permitting the toy to move from the station.

The toy vehicle preferably includes at least one gearbox for operating at least one motive means on the toy. The motive means includes a wheel for driving the vehicle into and from the station. There can be means to permit multiple vehicles, preferably serially, to enter the station. The disclosure allows the user to drive the car onto the charging station for power charging. There can be two or more cars in a set that allow the player to drive the cars on the track and/or onto the charging station for power charging.

A rechargeable system for a movable toy vehicle comprises a station having electrical outlet contacts, and means for providing recharging power through the outlets. A toy vehicle has inlet contacts for electrically engaging the outlet contacts when steered to the station and thereby receive the recharging power. The toy vehicle is steerable under remote control through a transmitter receiver system to engage the electrical outlet contacts. A rechargeable battery with the remote controlled toy vehicle powers motive means to move the toy.

The disclosure employs a remotely controllable car, selectively in infrared control, radio frequency control, programmable control or voice recognition control, equipped with a rechargeable battery that can be recharged by a charging station or track. A rechargeable track station contains electronic circuit and a battery or connection with an electrical mains source to generate power.

The disclosure can be operable in a defined track and more than one vehicle can be provided. There are many alternative configurations. There can be a situation with a rechargeable station located on the ground and the system can operate without a defined track.

The disclosure is directed to a system which includes a rechargeable station which receives vehicles movable on a surface. In some situations the vehicles may be other than a four wheel car. For instance, a two wheel or three wheel vehicle may be usable with or without a track. In other situations different kinds of vehicles other than a car may be used.

Although ideally wheels would be appropriate to move the vehicle on the surface, there can be situations where the mode of means are not wheels but other devices, for instance traction devices, to cause the vehicle or toy to move on the surface.

The one or two or more cars in the set have an electronic circuit which acts as a device to detect the power generated by a rechargeable track or base station through different methods like: metal contacts, magnetic field or light activated.

While the apparatus and method have been described in terms of what are presently considered to be the most practical and preferred embodiments, it is to be understood that the disclosure need not be limited to the disclosed embodiments.

It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A toy vehicle including a movable vehicle comprising a body, a chassis, wheels, a battery, the battery with the toy being for powering a motor within the toy to move the toy; sensors, a drive control for responding to sensors with the toy, the sensors being for sensing and monitoring the environment about the toy whereby the presence, movement or removal of objects about the toy cause a signal to be sent to a programmed circuit for generating a signal to powering the motor respectively to move, stop or turn the toy in a travel trajectory, and at least one sensor with the vehicle to determine at least two of:

a. sensing a vehicle-in-front slowing down,
b. sensing a vehicle-in-front stopping,
c. sensing of a vehicle-in-front brake lights illumination,
d. monitoring the occurrence of a traffic light; and
e. monitoring of a change in a sensed traffic light; and causing the vehicle to respond to the driving mechanism to respectively move, stop or turn the toy in a travel trajectory according to the sensing or monitoring.

2. The toy vehicle as claimed in claim 1 including a sensor to determine at least one of vehicle acceleration or a vehicle-in-front acceleration.

3. The toy vehicle of claim 1 including at least one sensor being part of a sensor system, an infrared receiver and smart driving software for acting as an effective functional visual system for responding to:

a. the sensing of a brake light of a vehicle-in-front thereby to minimize vehicle collision likelihood with the vehicle-in-front or
b. the monitoring of a traffic light.

4. The toy vehicle of claim 3 including a toy system having a lane track path, and a plurality of vehicles for location in the track.

5. The toy vehicle in a system of claim 4 wherein a. the vehicles in the track have different speeds, and the software is signaled about the differences in speed of different vehicles thereby to minimize a chance of a collision,
b. when a battery in a vehicle is low, the software is signaled, and the vehicle behind is notified to thereby effect a collision avoidance reaction, and
c. when a vehicle is stopped and is removed from the track by a player, and the software is signaled, and the vehicle behind responds by moving itself automatically.

6. The toy vehicle of claim 3 wherein the software is programmed to effect at least one action on the vehicle, according to the following protocol:

a. when the monitor senses a red traffic light, the smart driving software acts to stop the vehicle substantially immediately;
b. when the monitor senses a green traffic light, the vehicle moves;
c. when a sensor senses a vehicle-in-front stopping, the smart driving software acts to stop the vehicle substantially immediately; and
d. to avoid a collision, when a vehicle-in-front begins to move, the smart driving software acts to keep a vehicle behind waiting for a short while, and then permit start of movement.

7. A toy vehicle and remote controller, the vehicle comprising a body, wheels, a motor for powering a driving mechanism, and driving mechanism being for operating the wheels, a receiver with the toy for receiving a programming signal to effect operation of the driving mechanism such that the toy is drivable by the remote controller; a transmitter in the remote controller for sending the signal to the receiver; the toy being drivable under remote control by signals from the transmitter to the receiver, and at least one sensor with the vehicle to determine at least two of:

a. sensing a vehicle-in-front slowing down,
b. sensing a vehicle-in-front stopping,
c. sensing of a vehicle-in-front brake lights illumination,
d. monitoring the occurrence of a traffic light; and
e. monitoring of a change in a sensed traffic light; and causing the vehicle to respond to the driving mechanism to respectively move, stop or turn the toy in a travel trajectory according to the sensing or monitoring.

8. The toy vehicle of claim 7 wherein the transmitter comprises a. at least one start/stop button; and
b. one MCU to generate IR signals.

9. The toy vehicle of claim 8 wherein an effective range of an IR signal extends for several meters in order to cover multiple regions within a track.

10. The toy vehicle of claim 8 wherein the transmitter includes at least one of a. a Forward, Backward, Left and Right button thereby to support function and control and play with the vehicle off the track;
b. a universal ID in which the Start and Stop IR signal are suitable for multiple vehicles with different ID;
c. a smart driving system operable without the transmitter.

11. The toy vehicle of claim 7 wherein the transmitter includes a communication protocol of at least one of infrared, radio control; Bluetooth or WiFi control.

12. The toy vehicle of claim 7 included in a driving set, the set being operable with a traffic light, and the traffic light comprising:

a. at least one set of Red, Yellow/Amber, Green LED;
b. at least one source for sending a Red or Green command; and
c. one MCU to generate IR signals and control the light patterns and sequence of traffic light LED.

13. The toy vehicle of claim 12 operable such that:

a. when a Red light is on, a Red IR signal command is transmitted if a vehicle enters the signal effective zone and receives this signal, the vehicle stops substantially immediately
b. when a Green light is on, a Green IR signal command is transmitted if a vehicle is already within the signal effective zone, and the vehicle waits for short while and then start to move substantially automatically; and
c. the signal effective zone is located in front of a traffic light and the coverage area is substantially about 2 to 5 times of a vehicle dimension whereby the influence on other vehicles beyond this area is reduced.

14. The toy vehicle of claim 7 including:

a. an IR system on a front side such that a driving system is applied when the vehicle moves backward; and
b. the vehicle includes 2-way communication with front or rear vehicles and to exchange their status through wireless IR signaling.

15. The toy vehicle as claimed in claim 7 including sensors with the vehicle to determine at least three of a. b. c. d and e.

16. The toy vehicle as claimed in claim 7 including sensors with the vehicle to determine at least four of a. b. c. d and e.

17. The toy vehicle as claimed in claim 7 including sensors with the vehicle to determine a. b. c. d and e.

18. A toy vehicle and remote controller, the vehicle comprising a body, wheels, a motor for powering a driving mechanism, and driving mechanism being for operating the wheels, a receiver with the toy for receiving a programming signal to effect operation of the driving mechanism such that the toy is drivable by the remote controller; a transmitter in the remote controller for sending the signal to the receiver; the toy being drivable under remote control by signals from the transmitter to the receiver, and at least one sensor with the vehicle to determine at least one of:

i. sensing a vehicle-in-front slowing down, ii. sensing a vehicle-in-front stopping, iii. sensing of a vehicle-in-front brake lights illumination, iv. monitoring the occurrence of a traffic light; and v. monitoring of a change in a sensed traffic light; and causing the vehicle to respond to the driving mechanism to respectively move, stop or turn the toy in a travel trajectory according to the sensing or monitoring and wherein:

a. an effective range of a Go and a Brake IR signal is up to about 8 times of vehicle length so that it will not affect the cars in other regions of the track set;

b. an effective range of a Slow IR signal is less than that of the Go or the Brake signal;

c. optionally the vehicle includes an over-current detection circuit, whereby when a player holds at least one of the driving wheels and lead to motor stalled, the microprocessor measures this unexpected high current and stops the power to the motor; and d. optionally the vehicle includes with back an e.m.f. detection circuit, whereby when a motor stops, no back e.m.f. signal is generated from the motor, and when a player applies an external force to make the driving wheels turn, the motor induces back e.m.f., and the microprocessor measures this voltage change, activates a driving motor, and the vehicle moves.

19. A method of operating a movable toy comprising a movable toy, the toy having electrical contacts for electrically engaging charging station contacts when directed to a station; a battery with the toy for powering a motor with the toy to move the toy; rechargeable system for charging the battery, a drive control for responding to sensors with the toy, the sensors being for sensing and monitoring the environment about the toy whereby the presence, movement or removal of objects about the toy permit for signal to be sent to programmed circuit for generating a signal to the powering motor respectively to move, stop or turn the toy in a travel trajectory being operable upon receipt of a Stop IR signal from a transmitter or Red IR signal from traffic light or Brake IR signal from vehicle-in front such that a. the vehicle stops moving forward;

b. while stopping, upon receipt of a Start IR signal from transmitter or Green IR signal from traffic light or Go signal from a front vehicle, it waits for a while, then sends out the Go IR signal several times to rear direction before moving forward;

c. while stopping, the vehicle sends out Brake IR signal periodically;

d. when a rear vehicle receives the signal, the rear vehicle stops;

e. while moving forward, the vehicle sends out Slow IR signal periodically;

f. when a rear vehicle receives this signal, this vehicle reduces its forward speed gradually;

g. if the vehicle slows down by Slow IR signal or stopped by Red or Brake IR signal, when these signals disappear, the vehicle starts to move again automatically; and h. if a low battery is detected, the vehicle stops the driving motor and sends out Brake IR signal to the rear direction until the battery is flat.

20. The method of claim 19 including steering of the toy and including receiving at least one of an RF, programmable, voice, or IF controllable signal from a remote controller operable by a user of the toy.

21. The method of claim 19 including locating the toy selectively in a recharge station or track and the toy vehicle is normally directed to travel on the track.

22. A method of operating a toy vehicle of claim 19 comprising:

a. pressing a start/stop button to toggle the start or stop operation of a vehicle with a corresponding ID; or alternatively, b. the transmitter employs a separate start and stop button, and while pressing the start button, the transmitter sends out a start IR signal with unique ID; and a vehicle with a corresponding ID starts to move forward; and pressing Stop button, the transmitter sends out stop IR signal with unique ID; and a vehicle with a corresponding ID stops substantially immediately.

23. The method of operating a toy vehicle toy of claim 19 wherein the vehicle comprises at least one IR receiver; a rechargeable battery; a plurality of vehicle wheels for moving Forward, Backward, Left and Right; a contact terminal on the chassis of the vehicle for recharging; and one MCU being operable to effect at least one of:

a. driving at least one motor to control b. operating at least one LED;

c. handling signals from an IR receiver;

d. sending IR signals to a rear direction;

e. detecting a back e.m.f. signal from at least one motor; and f. monitoring a stall of at least one motor.

* * * * *